US005308477A

United States Patent [19]

Wiser et al.

[11] Patent Number: 5,308,477

[45] Date of Patent: May 3, 1994

[54] METHOD FOR COAL LIQUEFACTION

[75] Inventors: Wendell H. Wiser, Kaysville; Alex G. Oblad; Joseph S. Shabtai, both of Salt Lake City, all of Utah

[73] Assignee: University of Utah, Salt Lake City, Utah

[21] Appl. No.: 939,772

[22] Filed: Sep. 3, 1992

[51] Int. Cl.[5] ..... C10G 1/00; C10G 1/06

[52] U.S. Cl. ..... 208/400; 208/417; 208/419; 208/420; 208/423

[58] Field of Search ..... 208/400, 413, 417, 419, 208/420, 423

[56] References Cited

U.S. PATENT DOCUMENTS

| | | | |
|---|---|---|---|
| 3,030,297 | 4/1962 | Schroeder | 208/421 |
| 3,775,286 | 11/1973 | Mukherjee et al. | 208/423 |
| 3,960,700 | 6/1976 | Rosen et al. | 208/400 |
| 5,096,569 | 3/1992 | Maa et al. | 208/413 |

*Primary Examiner*—R. Bruce Breneman
*Assistant Examiner*—Patricia L. Hailey
*Attorney, Agent, or Firm*—Trask, Britt & Rossa

[57] ABSTRACT

A process is disclosed for coal liquefaction in which minute particles of coal in intimate contact with a hydrogenation catalyst and hydrogen arc reacted for a very short time at a temperature in excess of 400° C. at a pressure of at least 1500 psi to yield over 50% liquids with a liquid to gaseous hydrocarbon ratio in excess of 8:1.

20 Claims, 1 Drawing Sheet

METHOD FOR COAL LIQUEFACTION

This invention was made with Government support under Contract No. DE-AC22-88PC88817 awarded by the Department of Energy. The government has certain rights in the invention.

BACKGROUND OF THE INVENTION

1. Field of the Invention

The invention is a short residence coal liquefaction process in which more than fifty percent of the carbon in coal is converted to liquids, while limiting production of hydrocarbon (HC) gases, resulting in high ratios of liquids/HC gases.

2. State of the Art

Structurally, bituminous coal typically consists of monocyclic and condensed aromatic and hydroaromatic rings (clusters), varying in size from a single ring to perhaps four or five rings, which are linked to each other by connecting bridges which are typically short aliphatic chains or etheric linkages. Generally, coal liquefaction processes occur in the temperature range of 400° C.–500° C. by rupturing the connecting bridges to form free radicals or ions. The free radicals or ions are then capped by a small entity such as hydrogen. If the free radicals are not capped, they will combine in condensation or polymerization reactions to produce large structures which will be solid at room temperature.

Prior art coal liquefaction processes can be grouped into four different types of processes: pyrolysis (including hydropyrolysis), solvent extraction, catalytic hydrogenation with a solvent, and Fischer-Tropsch which is an indirect process.

In pyrolysis processes, coal is heated to 400° C. to 500° C. in the absence of any reacting atmosphere or in the case of hydropyrolysis, a hydrogen atmosphere, but without an externally-applied catalyst. The connecting bridges between the condensed ring units are thermally ruptured and the free radicals which are formed are stabilized by capping with hydrogen which is abstracted from some of the structural units in the coal. The total yield of liquids and gases by pyrolysis is typically in the range of 40% by weight of the coal. The remaining 60% by weight of the coal is a solid residue known as char.

Solvent extraction processes typically involve dissolving coal in a hydrogen donor solvent and heating to 400° C. to 450° C. One of the more advanced solvent extraction processes is the Exxon Donor Solvent Process of Exxon Oil Company. In this process a hydrogen donor solvent is added to coal feedstock to form a slurry which is then heated to a temperature of approximately 450° C. for approximately 15–20 minutes. While heating, hydrogen gas is added to the slurry.

In catalytic hydrogenation with a solvent, coal is dissolved in a hydrogen donor solvent, e.g. tetralin, to form a slurry, a hydrogenation catalyst is then introduced into the slurry and the slurry is heated to above 400° C. Hydrogen addition to the coal is approximately 4% to 5% by weight and the product is a liquid and gas ($C_1$–$C_4$ hydrocarbons) at room temperature. One of the most successful examples of a catalytic hydrogenation with a solvent process is the H-Coal process developed by Hydrocarbon Research, Inc.

The Fischer-Tropsch coal liquefaction technology, is the only liquefaction technology that is being utilized on a commercial scale. In the Fischer-Tropsch process, coal is gasified with oxygen and steam at a temperature which is usually above 950° C., to produce carbon monoxide and hydrogen. These gases are then reacted at a temperature of approximately 430° C., in the presence of an appropriate catalyst, to form gaseous and liquid hydrocarbons. In an alternative technology to produce hydrocarbons, coal is gasified to CO and $H_2$, which are then converted, principally to methanol by well-known technology. The methanol is then converted to gasoline using the Mobil ZSM-5 catalyst.

The prior art direct coal liquefaction technologies produce large amounts of hydrocarbon (HC) gases, ratios of liquids to HC gases usually being of the order 3/1 to 4/1, with none reported greater than about 7/. Residence times of the materials (reactants plus products) in the temperature zone above 350° C. are characteristically between 15 minutes and one hour. Such long exposure of the primary liquid molecules to temperatures above 350° C. results in extensive thermal cracking, yielding hydrocarbon gases. Since more than half of the gases thus formed is methane, this cracking results in large consumption of hydrogen.

SUMMARY OF THE INVENTION

Objectives

It is an objective of the invention to provide a coal liquefaction process in which more than fifty percent of the carbon in coal is converted to HC liquids. A further objective is to limit the production of HC gases in the coal liquefaction process, thereby producing a high ratio of liquids to HC gases greater than 8/1, by weight. It is a further objective of the invention to conserve hydrogen, an expensive reactant, in the production of liquids from coal. A final objective of this invention is to provide a coal liquefaction process in which reactor residence times of the coal are measured in seconds, preferably less than ten seconds.

Features

This invention is a method for converting coal to liquids which utilizes catalytic hydrogenation/hydrogenolysis in the absence of a solvent. The method comprises the steps of grinding coal feedstock into particles of an appropriate size range for feeding (for example a size range between 65 and 100 mesh, Standard Tyler Screen Series, or other finer size ranges); impregnating the coal particles with a catalyst having hydrogenation or hydrogenolysis activity; introducing, for very short times, e.g. less than about thirty seconds and preferably less than about ten seconds, the impregnated coal particles into a turbulent flow of hydrogen-containing gas at a temperature between 400° C. and 600° C. and a pressure greater than 1500 p.s.i.; and quenching the temperature of the products to below 300° C. Preferably, the hydrogenation catalysts are from the groups soluble hydrates of iron-containing salts, highly dispersed solid super acids, and volatile metal halides.

DETAILED DESCRIPTION F THE DRAWING

Figure 1:
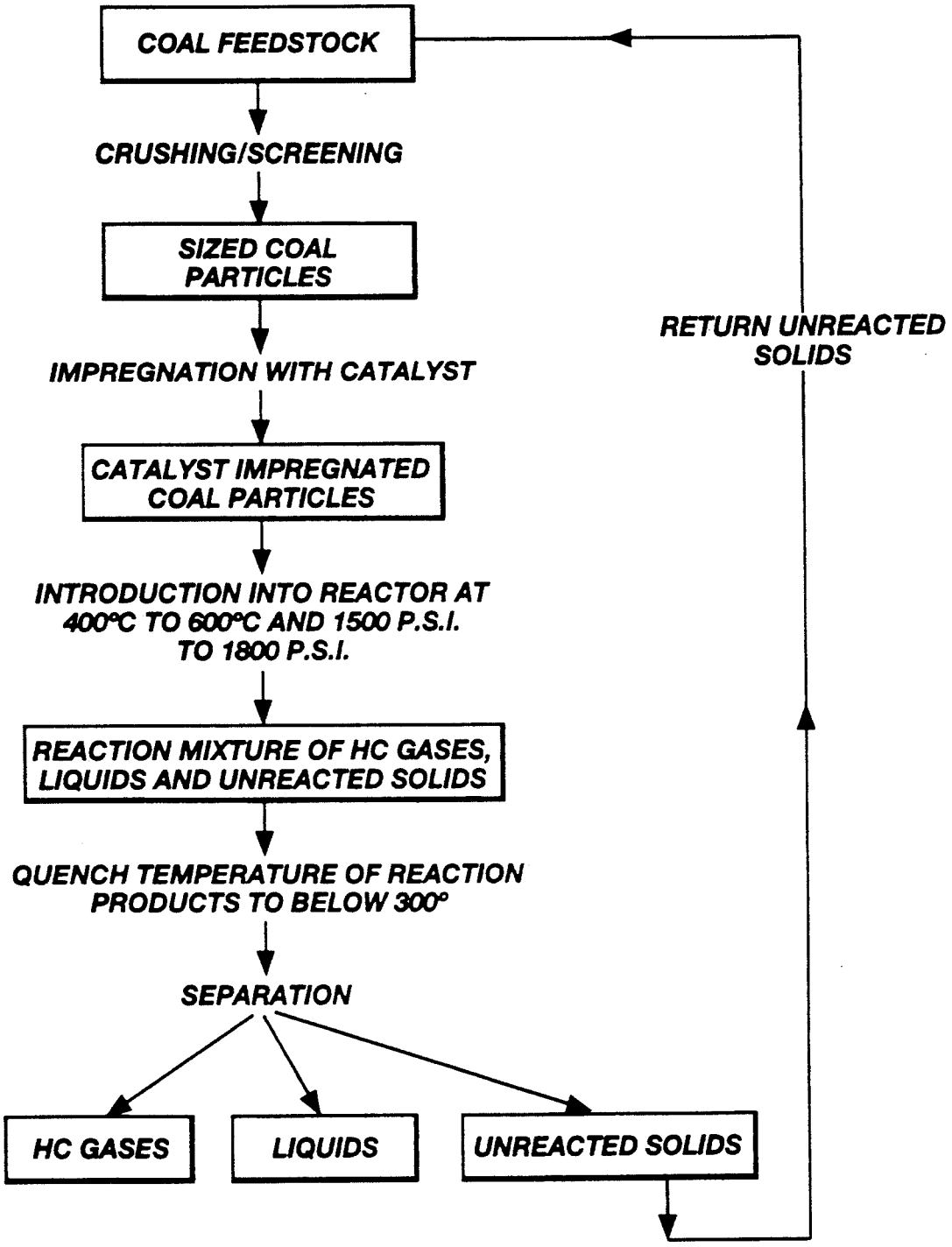
FIG. 1 is a schematic of the process of the invention.

As previously mentioned, the typical structure of coal suitable for conversion to liquids is monocyclic and condensed aromatic and hydroaromatic ring structures which are connected by structural bridges. Although it may be as large as four or five rings, the average size of a condensed ring unit is between two and three rings per cluster, and the clusters are joined principally by short aliphatic (alkylene) bridges or etheric linkages. Coal depolymerization in the temperature range of interest for direct production of liquids is initiated by thermal rupture of the chemical bonds joining the condensed units by a free-radical mechanism. Each free radical or ion, is then capped by addition of a small entity, preferably hydrogen, thereby forming a stable molecule. It is desirable that most of the molecules thus formed are either small enough to be part of a liquid phase at ambient temperature, or at least soluble in the liquids produced.

Historically, researchers reporting results of kinetic studies on direct conversion of coal to liquids have concluded that thermally-initiated depolymerization of coal is a first order reaction, with bond rupture between condensed clusters in the coal representing the slow or rate-determining step. Based upon extensive experimental data obtained by the present inventors, they have concluded that bond rupture of the inter-cluster linkages occurs very rapidly at temperatures above about 375° C. and is not the slow or rate-determining step in the kinetic sequence. Since only the formation of those molecules which escape from the solid reactant is observed in kinetic studies on coal, the rate-controlling step in the sequence, as measured by the evolution of products from the solid reactant, has been identified by the present inventors to be capping or stabilization of the free radicals or ions to form stable molecules. Non-catalytic addition of hydrogen from molecular hydrogen to cap the coal-derived free radicals or ions is observed by the present inventors to be slow in the temperature range suitable for high conversions to liquids. A suitable catalyst can increase the rate of hydrogen addition to stabilize the intermediate radicals or ions.

Coals suitable for conversion to high liquid yields contain rather high amounts of "hydroaromatic" carbons—a naphthenic ring attached to an aromatic ring in a condensed configuration. Typically 15 to 35 percent of the carbon atoms in such a coal are hydroaromatic carbons in accordance with this definition. Whereas the aromatic rings in the primary liquids formed do not thermally crack at the temperatures of interest, the hydroaromatic rings will crack. When this occurs, large quantities of hydrogen are consumed in the resulting formation of gases, the predominant gas being methane, $CH_4$, typically about two-thirds of the hydrocarbon gases produced.

It has been observed by the present inventors that the bridges joining the condensed clusters in coal, especially the methylene bridges, rupture more rapidly than do the bonds in the hydroaromatic rings. Since the rupture of bonds in these connecting bridges is observed to occur very rapidly, the present inventors determined that the application of an appropriate catalyst would permit capping the intermediate free radicals or ions at a sufficiently rapid rate to permit removal of the resulting primary liquid molecules from the hot zone of the reactor before appreciable thermal cracking could occur within the hydroaromatic portions of the liquid molecules. The experimentally-verified time in the hot zone (above 450° C.), which can allow high conversion to liquids, while minimizing HC gas production, is less than ten seconds, and ideally three to five seconds.

To obtain the desired result, coal particles must be heated very rapidly, to allow for extensive bridge bond rupture between clusters in very short times, even one to three seconds, followed by catalyzed stabilization of the intermediate radicals or ions to form mostly liquids, and rapid removal of the products from the hot zone. This combined operation is to be completed in the times previously mentioned. Therefore, the present invention provides for removal of the liquid products from the heated zone, above 350° C., before cracking becomes appreciable, thereby resulting in much higher ratios of liquids/HC gases than current state of the art, accompanied by greatly reduced hydrogen consumption.

Referring to FIG. 1, the method for converting carbon in coal into liquids, comprises the steps of dividing a coal feedstock into small particles, screening the particles into fractions suitable for feeding (e.g. between 65 and 100 mesh, Standard Tyler Screen Series, or finer size ranges); impregnating the coal particles with a catalyst having hydrogenation or hydrogenolysis activity; introducing, for less than 30 seconds, and preferably less than ten seconds, the impregnated coal particles into a turbulent flow of a hydrogen-containing gas at a temperature of between 400° C. and 600° C. and a pressure above 1500 p.s.i.; and quenching the temperature of the products to below 300° C. The purpose of dividing the coal particles is to permit rapid heating of the coal particles by the hot hydrogen gas in turbulent flow, as well as to provide a large surface area to mass ratio so that the coal particles are easily impregnated with the catalyst.

The coal particles may then be impregnated with the catalyst by any one of a number of techniques. These techniques include impregnation with a vapor phase catalyst, or impregnation by suspending the divided coal particles in a solvent containing the catalyst and then evaporating the solvent. The catalyst should be introduced into the coal feed at a temperature below 300° C. to avoid premature rupture of the connecting bridges.

There are three preferred groups of hydrogenation catalysts for the invention: soluble hydrates of iron-containing salts, highly dispersed solid superacids, and volatile metal halides.

Preferred soluble hydrates of iron-containing salts are $FeCl_3 \times 6H_2O$ or $Fe_2(SO_4)_3 \times 5H_2O$. Other salts, such as iron formate or iron acetate, can also be used. All of thee salts tend to form aqua complexes, e.g., $Fe(H_2O)_6^{3+}$, which act as protonic acids at elevated temperatures in the range of 300° C.–500° C. The protonic acidity is produced by partial dissociation of water ligands coordinated with the $Fe^{3+}$ ion in the complex. Impregnation of the coal feed with soluble aqua complexes of the above salts is performed from organic solvents, in particular acetone or methanol, and is facilitated by ultrasound mixing. Under such conditions, the soluble iron salt is uniformly dispersed through the pores in the coal particles and the catalytically active species are in immediate contact with the polymeric coal network, and are capable of directly attacking the intercluster linkages which hold together the coal building units. The uniform dispersion of the iron salt inside the coal particles has been recently demonstrated both by Mossbauer spectroscopy and electron probe microanalysis.

The preferable highly dispersed solid superacids are $Fe_2O_3/SO_4^{2-}$ and $ZrO_2/SO_4^{2-}$. Such superacids exhibit high protonic and/or Lewis acidity and are effective coal liquefaction catalysts at very low concentrations, such at 500–3000 ppm. These catalysts are easily miscible with a powdered coal feed.

The preferable volatile metal halides are $FeCl_3$ and $SnCl_4$. Aqua complexes of such acidic halides such as $FeCl_3 \times 6H_2O$ (b.p. 280°-285° C./760 torr) can be used directly in a solid, fine-particle form, by mixing with the powdered coal feed. At the high reaction temperature employed in the process of this invention, the volatile salt quickly diffuses through the coal particles and acts as an effective hydrogenolysis catalyst.

The five examples of the invention that follow are not in any way intended to limit the scope of the invention disclosed herein. Two bench-scale reactor systems have been designed, fabricated and operated which demonstrate the invention. A microreactor (operated as a batch reactor) and a continuous-flow tubular reactor have been constructed and operated, yielding the experimental results which follow. Times to achieve desired conversions in the tubular reactor are dependent upon the degree of turbulense in the reactor, which assist in particle heat-up and hydrogen transport to the reaction site. Very modest turbulence in tubular reactor experiments help to reduce the required times. Fully turbulent flow conditions reduce the total required times to a few seconds.

EXAMPLE 1

In a series of typical experiments in the batch microreactor, reaction parameters and results were as follows:

Coal feed: Wyodak sub-bituminous, −200 mesh
Reactor temperature: 500° C.
Reactor pressure: 1500 psig
Catalyst: $FeCl_3 \times 6H_2O$, impregnated from acetone solution

| Experiment Number | Single-Pass Experiments. Wt. % Conversion Ratio | | |
|---|---|---|---|
| | Time, Sec. | Liquids + HC gases | Liq./HC gases |
| A | 10 | 62 | 22 |
| B | 7 | 62 | 25 |
| C | 5 | 67 | 26 |
| D | 3 | 59 | 31 |

EXAMPLE 2

It is common industrial practice to recycle unreacted feed in order to increase the conversion to desired products, rather than try to achieve the desired conversion in a single pass. In order to test this concept, the unreacted solids from each experiment of Example 1 above were again treated with catalyst and passed a second time through the reactor. About two-thirds of those solids were converted in the second pass. The combined conversion in the two passes, based upon the original coal, was greater than 80% conversion to liquids and gases, with a combined ratio of liquids/gases ranging from 22/1 to 30/1. These results are presented below.

Coal Feed: Wyodak sub-bituminous, −200 mesh
Temperature: 500° C.; Pressure: 1500 psig
Catalyst: $FeCl_3.6H_2O$, impregnated from acetone solution

| Time secs | Pass | Pass % Conv. Liquids + HC Gases | Cum. Conv. Liquids + HC Gases | Pass Liq/HC Gases | Cumulative ratio Liq/HC Gases |
|---|---|---|---|---|---|
| 10 | 1st | 62 | 62 | 22 | 22 |
| 10 | 2nd | 55 | 83 | 22 | 22 |
| 7 | 1st | 62 | 62 | 25 | 25 |
| 7 | 2nd | 53 | 82 | 22 | 24 |

-continued

Coal Feed: Wyodak sub-bituminous, −200 mesh
Temperature: 500° C.; Pressure: 1500 psig
Catalyst: $FeCl_3.6H_2O$, impregnated from acetone solution

| Time secs | Pass | Pass % Conv. Liquids + HC Gases | Cum. Conv. Liquids + HC Gases | Pass Liq/HC Gases | Cumulative ratio Liq/HC Gases |
|---|---|---|---|---|---|
| 5 | 1st | 67 | 67 | 26 | 26 |
| 5 | 2nd | 46 | 82 | 27 | 26 |
| 3 | 1st | 59 | 59 | 31 | 31 |
| 3 | 2nd | 57 | 82 | 27 | 30 |

By carefully determining the quantity of solid stream to be recycled, coupled with an optimum conversion per pass, the results may approximate results presented as cumulative values in the above table.

EXAMPLE 3

In order to more readily visualize the surprising discovery of these results, cumulative two-pass conversions are presented separately in the Table below.

CUMULATIVE (COMBINED) TWO-PASS CONVERSION
(Reflecting What May Be Achieved With Recycle)
Coal Feed: Wyodak sub-bituminous, −200 mesh
Temperature: 500° C.; Pressure 1500 psig
Catalyst: $FeCL_3.6H_2O$, impregnated from acetone solution

| Time per Pass, sec | Cumulative Conversion Wt. % Liq + HC Gases | Cum. Ratio Liquids/HC Gases |
|---|---|---|
| 10 | 83 | 22 |
| 7 | 82 | 24 |
| 5 | 82 | 26 |
| 3 | 82 | 30 |

EXAMPLE 4

Acting in response to the trends revealed by experiments in the microreactor, experiments were conducted in a continuous-flow tubular reactor. Data from those experiments are shown in the following table. The residence time in the reactor for each pass was about 17 seconds.

Coal feed: Wyodak sub-bituminous, −65, +100 mesh
Reactor temperature: 450° C.
Reactor pressure: 1500 psig
Gas flow velocity: 0.8 feet/sec.
Catalyst: $FeCl_3 \times 6H_2O$, impregnated from acetone solution
Material balance: 93%, based upon dmmf coal.

| Pass | Pass % Conversion Liq. + Hc gases | Cumulative % Con. Liquids + gases | Pass Ratio Liq/HC gases | Cumulative Ratio Liq./HC gases |
|---|---|---|---|---|
| 1st | 55.6% | 55.6% | 8.3 | 8.3 |
| 2nd | 37.2% | 72.1% | 13.7 | 9.5 |

It is noted that in a single pass, a ratio of liquids/HC gases of 8.3/1.0 is achieved, at a conversion of 56% of the weight of the coal fed. This ratio of liquids to HC gases is much higher than achieved in current State-of-the-Art technologies. When the products from a second pass are combined with those of the first pass, ratios of liquids/HC gases of 9.5/1.0 are observed, at an overall conversion of 72% of the coal fed.

EXAMPLE 5

Experiments were conducted in the Continuous Tubular Reactor, with the temperature increased to 500° C. and the gas velocity through the reactor increased to 3.0 ft/sec. In the reactor of fixed length, this increased velocity resulted in a residence time in the reactor, calculated as gas residence time, of 4.3 seconds. The results are shown in the following table.

CONTINUOUS 3/16 INCH I.D. TUBULAR REACTOR
(laminar flow)
Coal Feed: Wyodak sub-bituminous, −100 +150 mesh
Temperature: 500° C.; Pressure 1500 psig
Catalyst: $FeCl_3.6H_2O$, impregnated from acetone solution

| Residence Time, sec. | Pass | Conversion wt. % Liq. + HC Gases | Ratio Liq/HC Gases |
|---|---|---|---|
| 4.3 | Single | 55 | 11.6 |
| (3.0 ft/sec) | Double | 76 | 14.0 |

It is noted that the combination of increased temperature and reduced residence time resulted in a conversion of 55% by weight of the coal to liquids in a single pass, with a ratio of Liquids/HC Gases of 11.6. When the unreacted solids were recycled to a second pass, the results from the combined two passes, expressed as weight percent of the original coal fed to the first pass, was 76% by weight, with a combined ratio of Liquids/HC Gases of 14.0, a value much higher than reported in State of the Art technologies. The gas velocity in the above experiments is still well into the laminar flow regime. As the velocities are increased into the fully turbulent regime, ratios of Liquids/HC Gases will continue to increase, approaching the values observed above in the batch microreactor.

These experiments, and others not reported here, reveal that the overall conversion of coal to liquids and gases (in times measured in seconds) by the present invention can be as great as conversion by state of the art technologies, by recycling unreacted solids with the fresh coal feed. However, whereas the state of the art technologies produce 15–20 weight percent of the coal as hydrocarbon gases during conversion to primary liquids, accompanied by a high consumption of hydrogen, this invention produces as little as 2–4 weight percent of the coal as hydrocarbon gases during conversion to primary liquids, accompanied by a very small hydrogen consumption.

It is clear from both the batch and continuous-flow experiments that incorporation of the multipass concept in conversion of coal to liquids exhibits the potential for greatly limiting formation of hydrocarbon gases with an attendant conservation of hydrogen.

The data presented in the above Examples reveal that, at temperatures in the range of 450° to 500° C., and possibly to as high as 550° C. or higher, rupture of the chemical bonds joining the structural units in coal, followed by catalyzed quenching of the free radicals or ions thus formed, occurs very rapidly, thereby initiating the conversion of coal to liquids. The data further reveal that a finite time of a few seconds may elapse following these initial reactions, before thermal cracking within the structural units to form hydrocarbon (HC) gases has become significant. It is noted that the shorter the time of exposure of the coal and its primary products to the elevated temperature of the reactor, the smaller the extent of cracking to form HC gases, and the higher the ratio liquids/HC gases. It is also noted that the total conversion of the coal to liquids and gases remains nearly constant, even down to reaction times of three seconds.

In order to derive maximum benefit from these factors, it is important to increase the temperature of the coal particle, even the whole particle, as rapidly as possible to the desired reaction temperature. Feeding the coal as finely divided particles is indicated. Hot hydrogen gas in turbulent flow has been demonstrated to be an excellent medium for rapid heating of solid particles. At atmospheric pressure diffusion of hydrogen molecules in a gas phase is observed to be faster than in a liquid by a factor of about 2000. Thus the coal particles should not be surrounded by a liquid phase during particle heat-up.

A new concept for feeding fine coal particles to a reactor whose pressure is 1500 psig or higher has been developed in connection with this coal liquefaction technology. It has been observed in supercritical-solvent extraction studies that many of the physical properties of a fluid in the supercritical state are essentially the same as those of a gas of similar-sized molecules at the same pressure. In particular the rate of diffusion of a gas in such a supercritical fluid is similar to diffusion in a gas phase at the same pressure, and substantially greater than in a liquid phase. A light oil, which is a liquid at ambient temperature but becomes supercritical upon entry into the heated reactor, is selected as a vehicle oil in which to slurry the coal particles. The finely-divided coal is slurried in the light oil and pumped into the heated and pressurized reactor, where the oil flashes to the supercritical state. The stream is joined inside of the reactor by a stream of hot hydrogen gas in turbulent flow, which heats the coal particles rapidly to the desired temperature, thus permitting the rapid conversion described above, and resulting in a high ratio of liquids/HC gases.

The instant invention essentially involves a process wherein coal particles, preferably very fine particles, are contacted intimately with a hydrogenation catalyst at temperatures and pressures conducive to rupture the HC linkages (bridges) between condensed aromatic/hydroaromatic rings [to rupture such HC bridges] in the presence of hydrogen and such catalyst to enhance the production of liquids as opposed to production of HC gases.

Reaction time (residence time in the reaction zone) is preferably short, i.e., only long enough to cause substantial rupture of the aliphatic or etheric bridges and the concomitant reaction of hydrogen with the ends of these ruptured bridges. Rapid reaction with hydrogen is very desirable to prevent the free radicals or ions from recombining into molecules which are undesirable and may be more difficult to crack into small molecules which are liquid at room temperature.

Various techniques may be utilized within the scope of this invention to promote the production of high ratios of liquids to HC gases. As indicated, a short residence time at reaction temperatures and pressures coupled with uniform, intimate distribution of the hydrogenation catalyst so that the ruptured bridges are hydrogenated rapidly to form liquids. Also, rapid removal of the liquid from the reaction zone precludes further degradation of these products. The term "liquids" or "liquid reaction product" is used to designate reaction products which are liquid at room temperature and atmospheric pressure even though those reaction products may not be liquids under the reaction temperature and pressure.

The reaction may be conducted in stages, e.g., by various passes through a reactor or by passing the unreacted coal particles through a series of reactors wherein short residence times and rapid removal of liquid reaction products at each stage occurs. While lower yields are obtained per pass, the overall yield is excellent while the ratio of liquids to HC gases is greatly enhanced.

While hydrogen is preferred generally as the heated gas which raises the coal particles to reaction temperature, recycled gas, i.e., HC gas, may be utilized.

While it is generally desired to pre-impregnate the coal particles and catalyst prior to feeding same to the reaction zone by adsorbing or absorbing catalyst from a liquid or vapor phase, the catalyst and coal particles may be simultaneously introduced into the reaction zone, especially if the reaction zone residence time is short such as presented in a multistage reaction wherein the residence time in each reaction zone is very short, and the catalyst has a high vapor pressure.

Vapor phase adsorption of catalyst may preferably be achieved in a stream of coal particles heated by recycled gases, i.e., where hydrogen is introduced separately into the reaction zone.

The impact of the present invention, and its novelty, lies in its ability to:

(1) Convert coal, in a single pass, to more than 50% by weight, liquids, while obtaining ratios of liquids/HC gases greater than 8/1;

(2) Convert coal, in a multi-pass, e.g. recycle, configuration to more than 70% by weight, liquids, while obtaining ratios of liquids/HC gases greater than 10/1;

(3) Achieving the above conversions and high liquid/HC gas ratios (both simultaneously) in times less than thirty seconds, and preferably less than ten seconds with residence times of less than five seconds being effective with times less than one second being feasible.

Whereas the invention is here illustrated and described with specific reference to an embodiment thereof presently contemplated as the best mode in carrying out such invention, it is to be understood that various changes may be made in adapting the invention to different embodiments without departing from the broad inventive concepts disclosed herein and comprehended by the claims that follow.

What is claimed is:

1. A method for converting more than 50% by weight coal to liquids wherein the ratio of liquids to hydrocarbon gases is greater than about 8:1, by weight comprising the steps of:

introducing finely divided particles of coal into a thermal cracking zone having a temperature of at least 400° C. and a pressure of at least of 1500 psi;

introducing a hydrogenation catalyst in intimate contact by way of impregnation with said coal particles into said thermal cracking zone and catalyst being substantially simulatenously introduced with said coal particles;

introducing hydrogen into said thermal cracking zone to react with said coal to form a reaction product;

maintaining said coal and hydrogen in said thermal cracking zone for a time period sufficiently short to yield a reaction product having a ratio of liquid to gaseous hydrocarbon products in excess of 8:1 by weight and a liquid content in excess of 50% of the weight of coal particles introduced into said cracking zone and unrelated coal; and quenching rapidly the reaction products to a temperature significantly less than 400° C.

2. The method of claim 1 wherein said reaction product is rapidly quenched to a temperature below about 300° C.

3. The method of claim 1 wherein said catalyst is introduced as a vapor phase catalyst to penetrate into the pores of the coal particles by virtue of being a vapor.

4. The method of claim 1 wherein said catalyst is impregnated into said coal particles.

5. The method of claim 1 wherein said catalyst is impregnated in said coal particles as solid-phase catalyst dissolved in a suitable solvent to impregnate the pores of said coal particles to ensure a high dispersion of the catalyst, said solvent then being evaporated.

6. The method of claim 5 wherein the catalyst is selected from the group consisting of soluble hydrates or iron-containing salts.

7. The method of claim 6 wherein the iron-containing salts are selected from the group consisting of ferric chloride hexahydrate, ferric sulfate pentahydrate, ferric formate and ferrous acetate.

8. The method of claim 5 wherein said the catalyst is a highly dispersed solid superacid.

9. The method of claim 8 wherein said superacid is $Fe_2O_3/SO_4^{-2}$ or $ZrO_2/SO_4^{-2}$.

10. The method of claim 5 wherein the catalyst is a volatile metal halide.

11. The method of claim 10 wherein said volatile metal halide is ferric chloride or stannic chloride or aqua complexes thereof.

12. The method of claim 1 wherein said coal particles, catalyst and hydrogen are introduced into a continuous-flow system.

13. The method of claim 1 wherein multiple stages cracking zones are present.

14. The method of claim 1 wherein the coal particles, catalyst and hydrogen introduced into a non-flow (batch) system.

15. The method of claim 1 wherein a portion of the unreacted coal (solids) is recycled to said thermal cracking zone.

16. The method of claim 1 wherein the coal particles are fed to the reactor as a dry solid.

17. The method of claim 1 wherein said coal particles have a size less than about 65 Tyler Screen mesh.

18. The method of claim 1 wherein the finely-divided coal containing impregnated catalyst is introduced as a slurry in a light oil such that, when the slurry is pumped into the heated reactor the oil will flash to a supercritical state.

19. A method for converting more than 70% by weight of coal to liquids, while yielding ratios of liquids/hydrocarbon (HC) gases greater than 12/1, by weight, comprising the steps of:

(a) grinding and screening the coal to fine particles of a size range less than about 65 mesh, Standard Tyler Series;

(b) applying to said coal particles a catalyst exhibiting hydrogenation/hydrogenolysis activity to obtain high dispersion of the catalyst within the coal particles;

(c) introducing said coal particles into a reactor hot zone maintained at a temperature between insert 450° C. and about 550° C. and a pressure of at least about 1500 psig, in the presence of a hot hydrogen stream;

(d) flowing said hydrogen and coal particles through said reactor hot zone at a rate to maintain turbulent flow;

(e) recycling unreacted coal to said reaction zone; and (f) controlling the residence time of said hydrogen and coal in said hot zone for a time of less than about 15 seconds.

20. The method of claim 19 wherein residence time at said coal and hydrogen in said hot zone is controlled to be less than about ten seconds.

* * * * *